US007225870B2

(12) United States Patent
Pedersen et al.

(10) Patent No.: US 7,225,870 B2
(45) Date of Patent: Jun. 5, 2007

(54) HYDRAULIC TOOLS FOR SETTING LINER TOP PACKERS AND METHOD FOR CEMENTING LINERS

(75) Inventors: Gerald D. Pedersen, Houston, TX (US); David E. Hirth, Pasadena, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 390 days.

(21) Appl. No.: 10/427,726

(22) Filed: May 1, 2003

(65) Prior Publication Data

US 2004/0216877 A1 Nov. 4, 2004

(51) Int. Cl.
*E21B 23/01* (2006.01)

(52) U.S. Cl. ..... 166/285; 166/382; 166/387; 166/122; 166/134; 166/136; 166/117.7; 166/181

(58) Field of Classification Search ..... 166/101, 166/117.7, 120, 122, 134, 50, 136, 187, 387, 166/285, 382, 181
See application file for complete search history.

(56) References Cited

U.S. PATENT DOCUMENTS 2,836,250 A * 5/1958 Brown ..... 166/134
3,112,796 A * 12/1963 Myers ..... 166/120
3,556,220 A * 1/1971 Schwegman ..... 166/120
4,856,591 A * 8/1989 Donovan et al. ..... 166/387
4,926,938 A * 5/1990 Lindsey, Jr. ..... 166/117.7
5,813,458 A * 9/1998 Smith et al. ..... 166/187
5,884,702 A * 3/1999 Yokley et al. ..... 166/285
6,554,062 B1 * 4/2003 Dewey et al. ..... 166/50

FOREIGN PATENT DOCUMENTS

EP 0477 452 4/1992
GB 2 373 006 9/2002

OTHER PUBLICATIONS

U.K. Search Report, Application No. 0409695.4, dated Jul. 30, 2004.
U.K. Search Report, Application No. GB0409695.4, dated Aug. 19, 2004.

* cited by examiner

*Primary Examiner*—David Bagnell
*Assistant Examiner*—Matthew J. Smith
(74) *Attorney, Agent, or Firm*—Patterson & Sheridan, L.L.P.

(57) ABSTRACT

Embodiments of the present invention relate to hydraulic tools which may be used to set a liner top packer and/or may be used to resist the lifting forces of cementing pack-offs. One embodiment of a tool string for use in wellbore operations comprises a hydraulic anchor assembly adapted to prevent axial movement of the tool string and a hydraulic packer actuator assembly adapted to set a packer.

44 Claims, 6 Drawing Sheets

HYDRAULIC TOOLS FOR SETTING LINER TOP PACKERS AND METHOD FOR CEMENTING LINERS

BACKGROUND OF THE INVENTION

1. Field of the Invention

Embodiments of the present invention generally relate to methods and apparatus for completing a well. Particularly, embodiments of the present invention relate to hydraulic tools which may be used to set a liner top packer and/or may be used to resist the lifting forces of cementing pack-offs.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps with the lower portion of the upper string of casing. The second "liner" string is then fixed or "hung" off of the upper surface casing. Afterwards, the liner is also cemented. This process is typically repeated with additional liner strings until the well has been drilled to total depth. In this manner, wells are typically formed with two or more strings of casing of an ever-decreasing diameter.

The process of hanging a liner off of a string of surface casing or other upper casing string involves the use of a liner hanger. The liner hanger is typically run into the wellbore above the liner string itself. The liner hanger is actuated once the liner is positioned at the appropriate depth within the wellbore. The liner hanger is typically set through actuation of slips which ride outwardly on cones in order to frictionally engage the surrounding string of casing. The liner hanger operates to suspend the liner from the casing string. However, it does not provide a fluid seal between the liner and the casing. Accordingly, it is desirable in many wellbore completions to also provide a packer.

During the wellbore completion process, the packer is typically run into the wellbore above the liner hanger. A threaded connection typically connects the bottom of the packer to the top of the liner hanger. Known packers employ a mechanical or hydraulic force in order to expand a packing element outwardly from the body of the packer into the annular region defined between the packer and the surrounding casing string. In addition, a cone is driven behind a tapered slip to force the slip into the surrounding casing wall and to prevent packer movement. Numerous arrangements have been derived in order to accomplish these results.

A problem associated with conventional mechanically actuated packer systems is the potential that the mechanical force applied to the packer may insufficiently set the packer resulting in a liner overlap without the desired pressure integrity. For example, in deviated or horizontal wellbores, the friction between the landing string and the wellbore limits the amount of mechanical force that can be applied to set the packer. Thus, this limited mechanical force may be insufficient to set or fully set the packer.

Hydraulically actuated packers can be set with the more consistent force of hydraulic pressure. A problem associated with conventional hydraulically actuated packers is that the landing string and running tools oftentimes must remain tied onto the liner for the packer to be actuated. Staying tied onto the liner during cementing operations increases the risk of having cement around the landing string and running tools without being able to release from the liner.

Another problem associated with conventional hydraulically actuated packers is that the packers may prematurely set. For example, some conventional hydraulically actuated packers are actuated by applying a hydraulic pressure to shear the shearable device to release the packer actuating sleeve/polished bore receptacle, or other actuator device. Thus, if a hydraulic pressure is increased over the force required to overcome the shearable device, the packer can prematurely set.

Another problem encountered when installing liners is that during the cementing of liners the hydraulic pressure of the cement acts on the cementing pack-off and urges the cementing pack-off upward. Sufficient downward force must be applied to the running tool assembly to resist the cementing pack-off from being lifted out of sealing engagement with the liner or the cementing pack-off must be mechanically locked to the liner to resist movement. In deviated or horizontal wellbores, the amount of force that can be applied to resist this lifting force may be limited by the friction between the landing string and the wellbore. A problem with mechanically locked cementing pack-offs is that the cementing pack-off may become stuck and may be difficult to be released from the liner.

Therefore, there is a need for an improved device and method for setting liner top packers. In addition, there is a need for an improved device for resisting the lifting forces of cementing pack-offs.

SUMMARY OF THE INVENTION

Embodiments of the present invention relate to hydraulic tools which may be used to set a liner top packer and/or may be used to resist the lifting forces of cementing pack-offs.

One embodiment of a tool string for use in wellbore operations comprises a hydraulic anchor assembly adapted to prevent axial movement of the tool string and a hydraulic packer actuator assembly adapted to set a packer.

One embodiment of a hydraulic packer actuator for use in wellbore operations comprises a tubular member having an inner diameter. A piston is moveably coupled to the tubular member and is adapted to move axially in relation to the tubular member between an unextended position and an extended position. A chamber is formed between the tubular member and the piston and a port provides fluid communication between the inner diameter of the tubular member and the chamber. A hydraulic pressure applied to the inner diameter of the tubular member moves the piston axially and moves a shoulder coupled to the piston axially.

One embodiment of a hydraulic anchor comprises a tubular member having one or more piston chambers. Each piston chamber is in fluid communication with an inner diameter of the tubular member. A piston having a gripping surface disposed on an end thereof is disposed in each chamber. Each piston and gripping surface is adapted to move radially outward.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
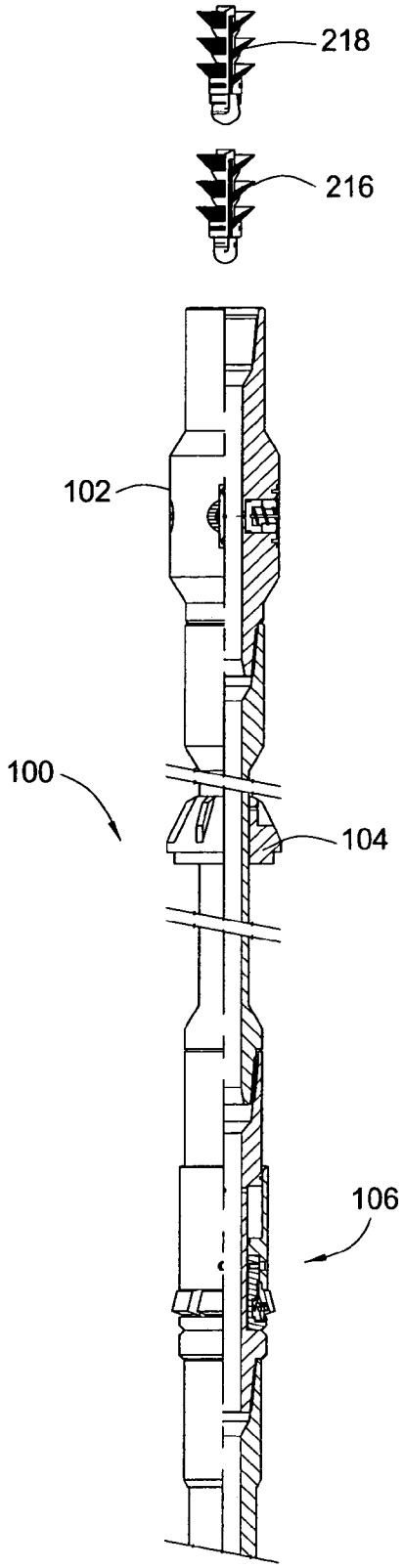
FIGS. 1A–1B are schematic partial cross-sectional views of one embodiment of a running tool assembly with associated equipment.

Embodiments of the present invention generally relate to methods and apparatus for completing a well. Particularly, embodiments of the present invention relate to hydraulic tools which may be used to set a liner top packer and/or may be used to resist the lifting forces of cementing pack-offs.

Embodiments of the invention are described below with terms designating orientation in reference to a vertical wellbore. These terms designating orientation should not be deemed to limit the scope of the invention. Embodiments of the invention may also be used in a non-vertical wellbore, such as a horizontal wellbore.

FIGS. 1A–1E are schematic side partial cross-sectional views of one embodiment of a running tool assembly 100 with associated equipment and a liner hanger assembly 200. During run in, the running tool assembly 100 is loaded into the liner hanger assembly 200. The landing string (not shown) and running tool assembly 100 is used to lower the liner hanger assembly 200 into position within the casing (not shown) and the wellbore (not shown). The running tool assembly 100 may be eventually recovered from the wellbore while the liner hanger assembly 200 remains in the wellbore after the liner has been set in position.

The running tool assembly 100 may include various tools. For example, as shown in the figure, the running tool assembly 100 comprises a hydraulic anchor assembly 102, a junk bonnet 104, a hydraulic packer actuator assembly 106, running tool 107, cup type cement pack-offs 108, and a plug set 110. The liner hanger assembly 200 may include various completion tools. For example, as shown in the figure, the liner hanger assembly 200 comprises a packer actuating sleeve 202, a liner top packer 204, a liner hanger 206, a liner 208, a landing collar 210, a float collar 212, and a float shoe 214. During run-in, the running tool assembly 100 is inserted into the liner hanger assembly 200 until a shoulder on the junk bonnet 104 contacts the top of the packer actuating sleeve 202. The running tool assembly 100 is coupled to the liner hanger assembly 200 by engaging threads on the running tool 107 with mating threads 207 in the liner hanger assembly 200. The running tool assembly 100 and the liner hanger assembly 200 may comprise other configurations and other tools. For example, any cement pack-offs may be used such as conventional polished bore receptacle pack-offs and retrievable pack-off bushings.

Figure 1B:
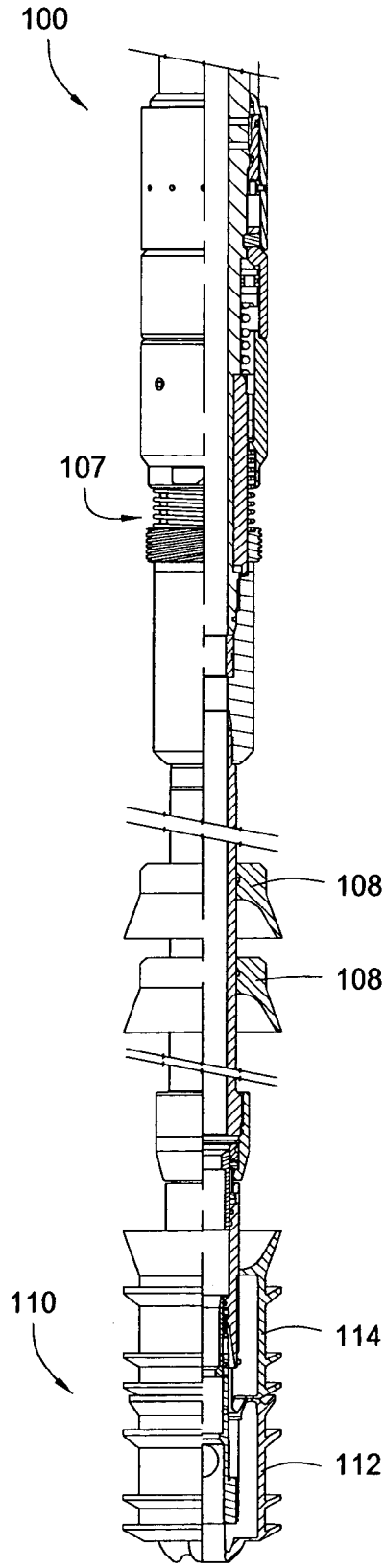
Figure 1C:
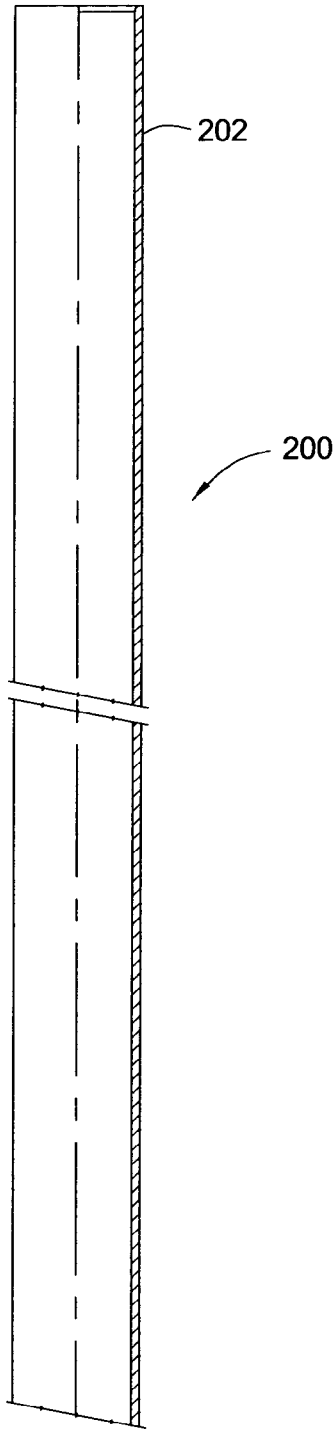
FIGS. 1C–1E are schematic partial cross-sectional views of one embodiment of a liner hanger assembly with associated equipment.
Figure 1D:
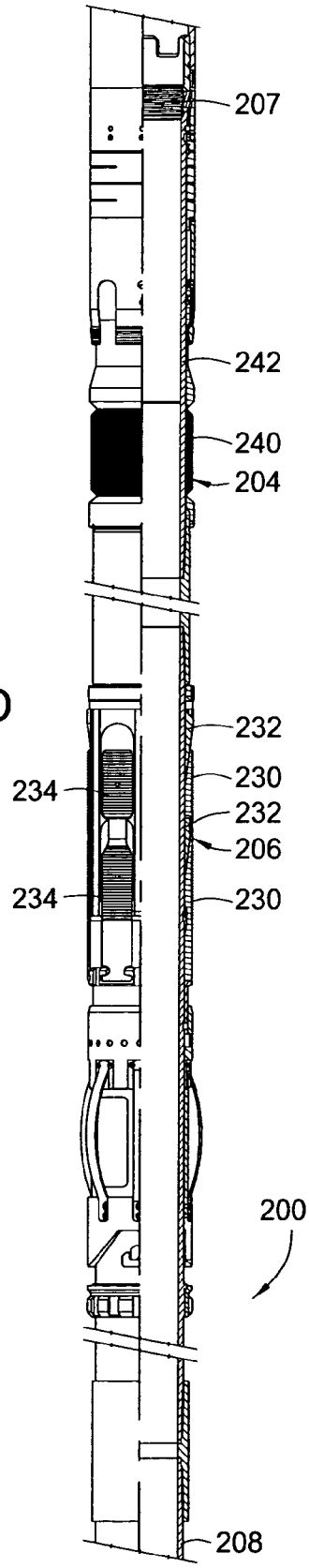
Figure 1E:
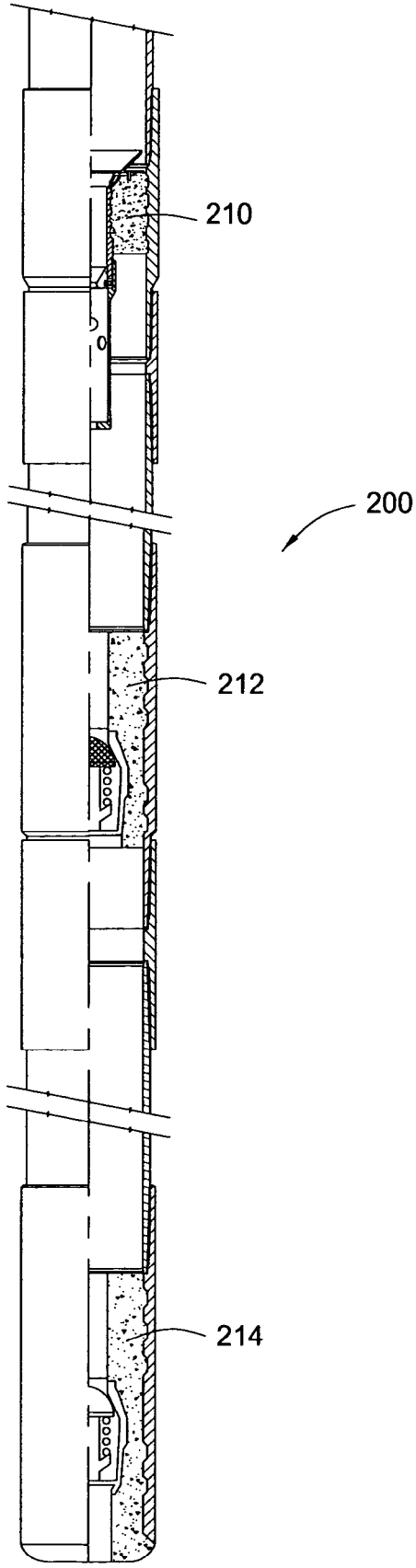
Figure 2:
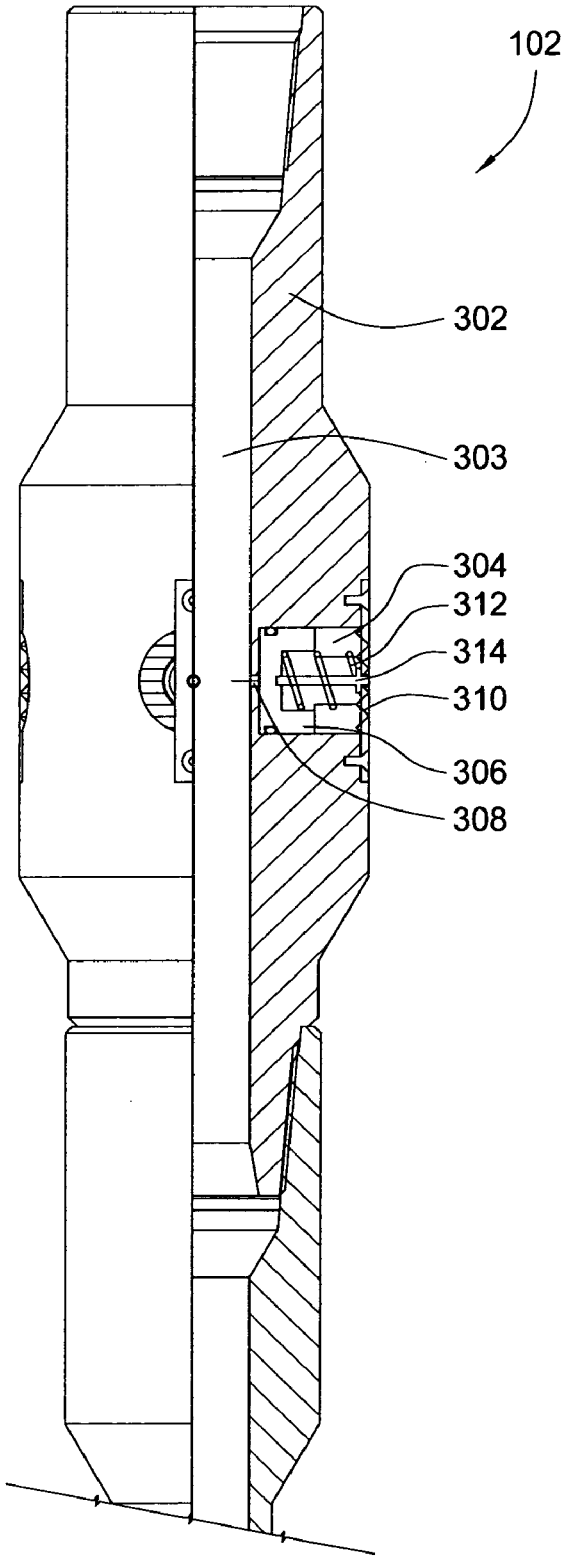
FIG. 2 is a schematic partial cross-sectional view of one embodiment of hydraulic anchor assembly of FIG. 1.

FIG. 2 is a schematic partial cross-sectional view of one embodiment of hydraulic anchor assembly 102 of FIG. 1. The hydraulic anchor assembly 102 comprises a tubular member 302 having one or more piston housings 304. There is at least one port 308 for each piston housing 304 providing fluid communication between the piston housing 304 and the inner diameter 303 of the tubular member 302. At least one piston 306 is disposed in each piston housing 304 and is adapted to move radially between a retracted position and an extended position. A gripping surface 310 is disposed on one end of the piston 306 to engage with the inner surface of the casing or liner when the piston 306 and the gripping surface 310 are in an extended position. An optional spring 312 or other biasing member may be disposed in the piston housing 304 to bias the piston 306 in a retracted position and/or to return the piston 306 from an extended position to a retracted position. The hydraulic anchor assembly 102 may optionally further include a frangible device 314, such as a shearable member, restraining movement of the piston 306 to prevent premature deployment of the piston 306 and the gripping surface 310 in an extended position until a sufficient hydraulic pressure is applied to the piston 306 to break the frangible device 314.

In operation, a hydraulic pressure is applied to the inner diameter 303 of the tubular member 302 and, consequently, through the port 308 to the piston housing 304. When the hydraulic pressure against the piston 306 exceeds the bias of the spring 312 and integrity of the frangible device 314, the frangible device 314 breaks and the piston 306 and the gripping surface 310 move radially to an extended position. In an extended position, the gripping surface 310 may engage the inner surface of the casing or the liner to prevent relative axial movement between the hydraulic anchor assembly 102 and the casing or the liner and, thus, also to prevent relative axial movement between the running tool assembly 100 and the casing or the liner.

Figure 3:
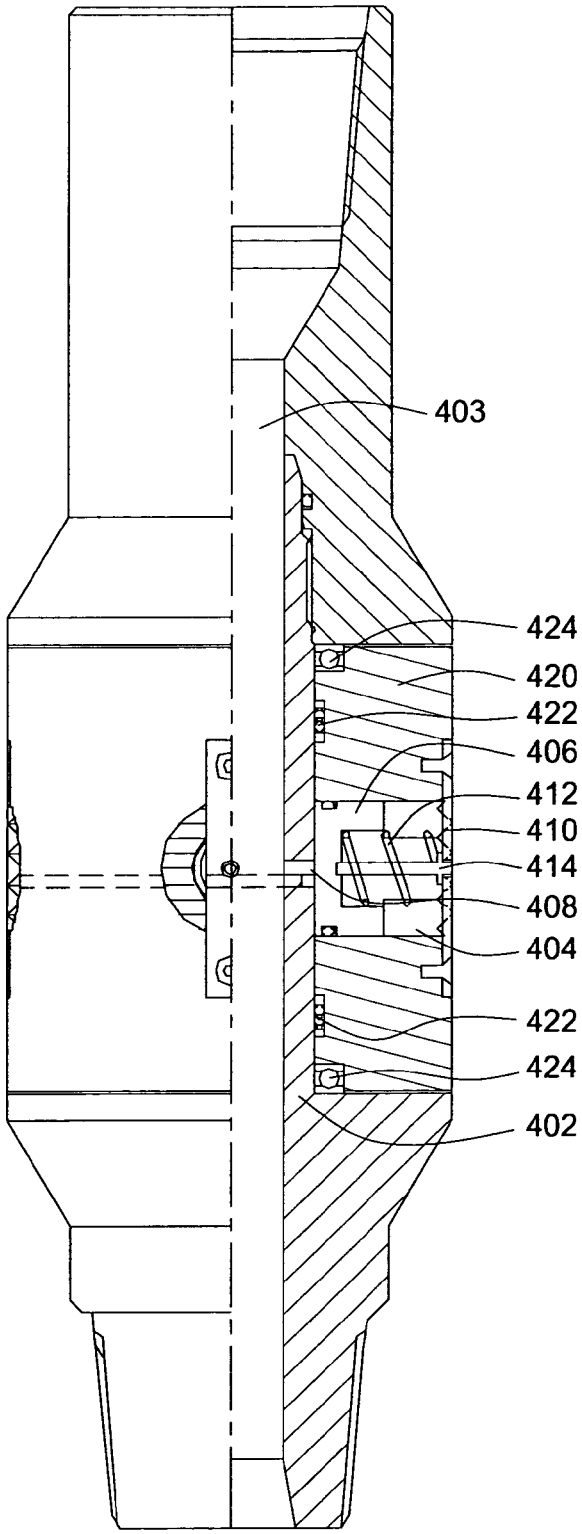
FIG. 3 is a schematic partial cross-sectional view of another embodiment of hydraulic anchor assembly of FIG. 1.

FIG. 3 is a schematic partial cross-sectional view of another embodiment of hydraulic anchor assembly 102 of FIG. 1. The hydraulic anchor assembly comprises a tubular member 402. A rotateable sleeve 420 is disposed around the tubular member 402 and includes one or more piston housings 404. At least one port 408 is formed in the tubular member 402 to provide fluid communication between the piston housing 404 and the inner diameter 403 of the tubular member 402. A rotary seal 422 resides on either side of port 408 that seals between the tubular member 402 and the rotateable sleeve 420. This seal permits rotation of the rotateable sleeve 420 while maintaining pressure integrity. Optionally there are bearings 424 placed above and below the piston housing 404 to reduce friction when rotating with an axial load applied to the anchor assembly. At least one piston 406 is disposed in each piston housing 404 and is adapted to move radially between a retracted position and an extended position. A gripping surface 410 is disposed on one end of the piston 406 to engage with the inner surface of the casing or the liner when the piston 406 and the gripping surface 410 are in an extended position. An optional spring 412 or other biasing member may be disposed in the piston housing 404 to bias the piston 406 in a retracted position and/or to return the piston 406 from an extended position to a retracted position. The hydraulic anchor assembly 102 may optionally further include a frangible device 414, such as a shearable member, restraining movement of the piston 406 to prevent premature deployment of the piston 406 and the gripping surface 410 in an extended position until a sufficient hydraulic pressure is applied to the piston 406 to break the frangible device 414.

In operation, a hydraulic pressure is applied to the inner diameter 403 of the tubular member 402 and, consequently, through the port 408 to the piston housing 404. When the hydraulic pressure against the piston 406 exceeds the bias of the spring 412 and the integrity of the frangible device 414, the frangible device 414 breaks and the piston 406 moves radially to an extended position. In an extended position, the gripping surface 410 may engage the inner surface of the casing or the liner to prevent relative axial movement between the hydraulic anchor assembly 102 and the casing or the liner and, thus, also to prevent relative axial movement between the running tool assembly 100 and the casing or the liner.

The rotateable sleeve 420 allows rotation through the hydraulic anchor assembly 102 while the piston 406 and the gripping surface 410 are in an extended position preventing axial movement thereof. For example, the hydraulic anchor assembly 102 permits the running tool assembly 100 and/or the liner hanger assembly 200 to be rotated during cementation, during setting the packer, and/or during other operations while the hydraulic anchor assembly 102 is actuated.

Other embodiments of hydraulic anchor assembly 102 are also possible. For example, a hydraulically actuated slip and cone arrangement may be used as the anchoring device instead of or in conjunction with the radially moveable pistons 306, 406 of FIGS. 2 and 3.

Figure 4:
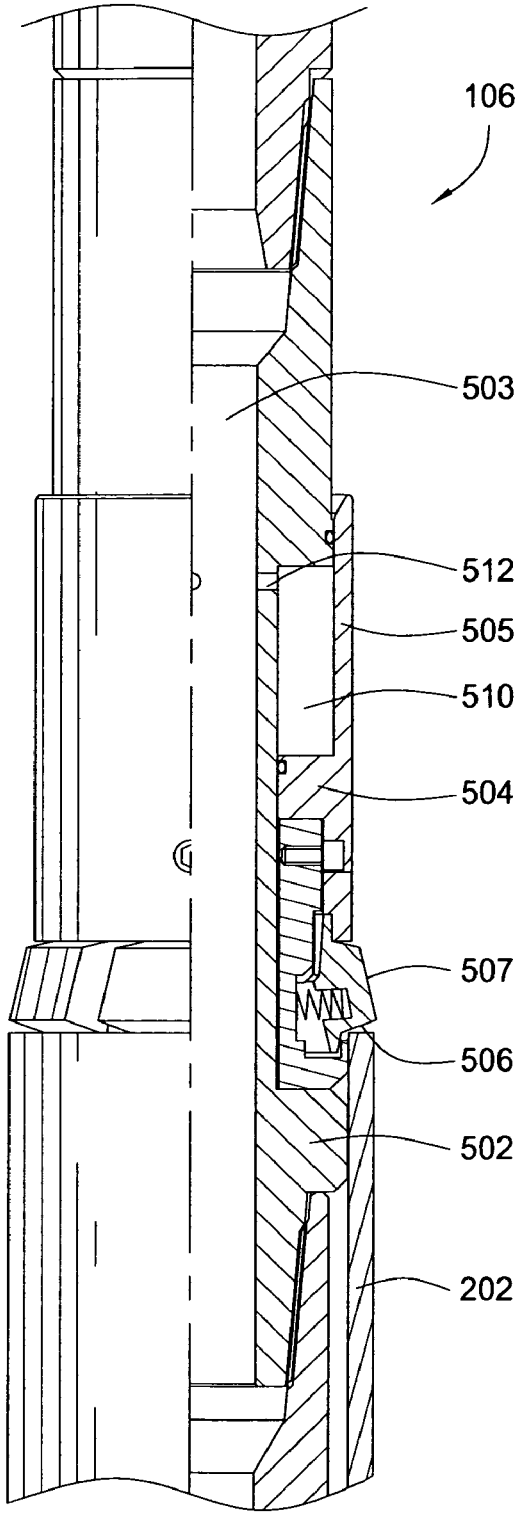
FIG. 4 is a schematic partial cross-sectional view of one embodiment of hydraulic packer actuator assembly of FIG. 1.

FIG. 4 is a schematic partial cross-sectional view of one embodiment of the hydraulic packer actuator assembly 106 of FIG. 1. The hydraulic packer actuator assembly 106 comprises a tubular member 502 and an axially moveable piston 504. For example, as shown, the axially moveable piston 504 comprises a slideable sleeve 505 disposed around the tubular member 502 in which the slideable sleeve 505 forms a chamber 510 with the tubular member 502. One or more ports 512 provide fluid communication between the chamber 510 and the inner diameter 503 of the tubular member 502. When a hydraulic pressure is applied to the inner diameter 503 of the tubular member 502, a hydraulic pressure is also applied to the piston 504 and may move the piston 504 from an unextended position downward to an extended position.

A shoulder 506 is coupled to the piston 504 to apply an axial force as the piston 504 is moved from an unextended position to an extended position. In addition, the shoulder 506 may be adapted to expand from a first outer diameter to a second outer diameter. For example, as shown in the figure, the shoulder 506 comprises one or more spring-loaded dogs 507. In another embodiment, the shoulder 506 may comprises one or more c-rings comprising a metal material or other suitable material which has a modulus of elasticity capable of being compressed and capable of expanding.

In operation of one embodiment of the hydraulic packer actuator assembly 106, the first outer diameter of expandable shoulder 506 of the hydraulic packer actuator assembly 106 is smaller than the inner diameter of a packer actuating sleeve, such as the packer actuating sleeve 202 of FIG. 1B, so that the hydraulic packer actuator assembly 106 may reside in the packer actuating sleeve 202 during run in. When the expandable shoulder 506 is removed from the packer actuating sleeve 202, the expandable shoulder 506 expands to the second outer diameter which is greater than the inner diameter of the packer actuating sleeve 202 as shown in FIG. 4. When a hydraulic pressure is applied to the inner diameter 503 of the tubular member, a hydraulic pressure is also applied to the piston 504 through ports 512 and may move the piston and the shoulder from an unextended position down to an extended position. During the stroke downward, the shoulder 504 may apply an axial force, such as to the packer actuating sleeve 202.

In reference to FIGS. 1–4, one embodiment of the method of hydraulically cementing the liner 208 and setting the liner top packer 204 with the hydraulic anchor assembly 102 and the hydraulic packer actuator assembly 106 comprises loading the hydraulic packer actuator 106 inside the packer actuating sleeve 202 during run in. Since the hydraulic packer 106 resides inside the packer actuating sleeve 202, the liner top packer 204 cannot be prematurely set.

The liner hanger assembly 200 is lowered to a desired position so that the liner hanger 206 is positioned above the lower end of the casing string (not shown). The liner hanger 206 may be any liner hanger known in the art. The liner hanger 206 is set to hang the liner 208 to the casing. For example, as shown in the figure, the liner hanger 206 comprises a plurality of slips 230 and respective cones 232. During actuation of the linger hanger 206, the slips 230 are driven upward in relation to the cones 232. Because the cones 232 comprise an angled surface, the slips 230 are driven radially outward in contact with the inner surface of the casing. The slips 230 typically include a set of teeth 234, referred to "wickers," which provide frictional engagement between the liner hanger and the inner surface of the casing. The liner hanger 206 is typically set hydraulically or mechanically.

The running tool assembly 100 is released from the liner hanger assembly 200 so that the weight of the liner 208 is carried by the liner hanger 206 by a known device in the art. For example, the running tool assembly 100 may be released from the liner hanger assembly 200 by unscrewing the running tool assembly 100 from the liner hanger assembly 200. Typically, the running tool assembly 100 is lifted a short distance but not far enough to remove the hydraulic packer actuator assembly 106 from the packer actuating sleeve 202 in order to determine if the running tool assembly 100 is free of the weight of the liner hanger assembly 200.

Then, a cement slurry may be pumped from the surface down through the landing string (not shown), through the running tool assembly 100, through the liner hanger assembly 200, through the float shoe 214 and up the annulus between the liner 208 and the wellbore and up the second annulus between the running string and the casing. The cement slurry may be pumped at a sufficient hydraulic pressure to activate the hydraulic anchor assembly 102 so that the gripping surface 310, 410 moves to an extended position gripping the casing or the liner and, thus, helping to prevent upward movement of the running tool assembly 100 due to the upward force against the cup type cement pack-offs 108.

After a desired amount of cement slurry has been pumped, and the cement wiper plugs 112 and 114 have bumped on the landing collar 210, the hydraulic pressure within the inner diameter of running 100 may be released so that gripping surface 310, 410 of the hydraulic anchor assembly 102 retracts due to bias of the spring 312, 412. Then, the running tool assembly 100 may be raised to remove the hydraulic packer actuator 106 from inside of the packer actuating sleeve 202 so that the spring-loaded dogs 507 expand radially outward. The running tool assembly 100 is then lowered down so that the spring-loaded dogs 507 contact the top of the packer actuating sleeve 202 until the chamber 510 of the hydraulic packer actuator 106 is closed and the piston 504 is in an unextended or upward position.

An initial set down force is applied to the running tool assembly 100 while a hydraulic pressure is applied to the inner diameter of the running tool assembly 100. The cement wiper plugs landed on the landing collar provide a means for increasing pressure in the running tool assembly and liner. Alternatively a separate device could be released from surface that is designed to sealably engage on a preinstalled profile located below the hydraulic packer actuator. The initial set down force mechanically applied to the running tool assembly 100 is preferably sufficient enough to resist the lifting force of the piston 504 of the hydraulic packer actuator 106 against the packer actuating sleeve 202 until the piston 306, 406 of the hydraulic anchor assembly 102 can overcome any spring bias and until the piston 306, 406 extends radially so that the gripping surface 310, 410 provides a sufficient anchor with the casing or the liner to prevent axial movement of the running tool assembly 100.

The hydraulic pressure applied to the inner diameter of the running tool assembly 100 increases the size of the chamber 510 and moves the piston 504 downward. Since the running tool assembly 100 is anchored in place by the hydraulic anchor assembly 102 and liner hanger assembly 200 is hanged to the casing, the downward movement of the piston 504 causes the spring-loaded dogs 507 to apply an axial force downward against the top of the packer actuating sleeve 202 to set the liner top packer 204. In one aspect, this axial force applied by spring-loaded dogs 507 due to the hydraulic pressure provides a more consistent axial force than applying a mechanical force through the running tool assembly 100 since there are no attendant losses due to the friction with the landing string (not shown) and the casing.

The liner top packer 204 may be any packer known in the art. For example, the liner top packer 204 may include a sealing element 240 disposed around a tubular member 242. The sealing element 240 is capable of sealing an annulus between the liner hanger assembly 200 and the casing. The sealing element 240 may comprise an elastomeric material, a composite material, combinations thereof, and other suitable materials and may have any number of configurations to effectively seal the annulus. For example, the sealing element 240 may include grooves, ridges, indentations, or protrusions designed to allow the sealing element 240 to conform to variations in the shape of the interior of the surrounding casing.

The hydraulic pressure to the inner diameter of the running tool assembly 100 can be increased until a sufficient force is imparted to set the liner top packer 204. After the packer is fully set, the hydraulic pressure can be released. The piston 306, 406 and the gripping surface 310, 410 of the hydraulic anchor assembly 102 retract back. Excess cement may be circulated out and the running tool assembly 100 may be retrieved from the wellbore.

As shown in FIGS. 1A–1B, the hydraulic anchor assembly 102 is disposed above the hydraulic packer actuator assembly 106. In certain embodiments of this configuration, the gripping surface 310, 410 of the hydraulic anchor assembly 102 actuated may grip the casing or previously cemented liner. In another embodiment, the hydraulic anchor assembly 102 may be disposed below the hydraulic packer actuator assembly 106. In certain embodiments of this configuration, the gripping surface 310, 410 of the hydraulic anchor assembly 102 when actuated may grip the liner, such as liner 208.

The present method may further include the use of balls, darts, plugs, ball seats, landing collars, ruptureable seats, ruptureable membranes, and/or other know devices in the art to separate fluids, to allow a pressure to be built up, and/or to allow a hydraulic pressure to be released.

While the foregoing is directed to embodiments of the present invention, other and further embodiments of the invention may be devised without departing from the basic scope thereof, and the scope thereof is determined by the claims that follow.

The invention claimed is:

1. A tool string for use in wellbore operations, comprising:

a hydraulic anchor assembly adapted to prevent axial movement of the tool string, the hydraulic anchor assembly having:

a gripping surface movable between a retracted position and an extended position;

a biasing member biasing the gripping surface in the retracted position;

a tubular member;

one or more piston chambers, each piston chamber in fluid communication with an inner diameter of the tubular member; and a piston disposed in each chamber, each piston adapted to move radially and having the gripping surface disposed on an end thereof, the one or more piston chambers of the anchor assembly are disposed in a rotatable sleeve;

a hydraulic packer actuator assembly adapted to actuate a liner hanger assembly having a liner hanger and a packer; and a tubular gripping member adapted to releasably engage and support the liner hanger assembly during run in.

2. The tool string of claim 1, wherein the packer comprises a liner top packer.

3. The tool string of claim 1, wherein a hydraulic pressure within an inner portion of the tool string actuates both the hydraulic anchor assembly and the hydraulic packer actuator assembly.

4. The tool string of claim 1, wherein the hydraulic anchor assembly is adapted to grip the inside of a casing.

5. The tool string of claim 1, wherein the hydraulic packer actuator assembly is disposed below the hydraulic anchor assembly.

6. The tool string of claim 1, wherein the hydraulic anchor assembly is adapted to grip the inside of a liner.

7. The tool string of claim 1, wherein the hydraulic packer actuator assembly resides in a packer actuating sleeve during run in.

8. The tool string of claim 1, wherein the hydraulic packer actuator assembly is adapted to apply an axial force to a packer actuating sleeve to set the liner.

9. The tool string of claim 1, wherein the hydraulic packer actuator assembly comprises:

a tubular member having an inner diameter;

a piston moveably coupled to the tubular member, the piston adapted to move axially in relation to the tubular member to an extended position to set the packer;

a shoulder coupled to the piston;

a chamber formed between the tubular member and the piston; and a port providing fluid communication between the inner diameter of the tubular member and the chamber.

10. The tool string of claim 1, wherein the hydraulic anchor assembly is adapted to permit rotation of the tool string while preventing axial movement of the tool string.

11. The tool string of claim 1, wherein the hydraulic anchor assembly comprises a frangible device to prevent premature actuation of thereof.

12. The tool string of claim 1, wherein the biasing member comprises a spring.

13. The tool string of claim 1, wherein the anchor assembly further comprises a frangible device adapted to temporarily secure the gripping surface in the retracted position.

14. The tool string claim 1, wherein the gripping surface of the anchor assembly comprises one or more slips adapted to move radially outward over one or more cones.

15. The tool string of claim 1, wherein the tubular gripping member comprises a running tool adapted to engage an inner surface of the liner hanger assembly.

16. The tool string of claim 1, wherein the hydraulic packer actuator assembly is disposed between the hydraulic anchor assembly and the tubular gripping member.

17. The tool string of claim 1, wherein the hydraulic anchor assembly is adapted to permit rotation of the tool string while preventing axial movement of the tool string when the gripping surface is in the extended position.

18. A method for cementing a liner, comprising:

providing a liner assembly coupled to a running tool assembly, the running tool assembly having a hydraulic packer actuator and an anchor;

running the liner assembly to a lower portion of a casing, the liner assembly comprising a packer actuating sleeve, a liner top packer, a liner hanger, and the liner;

setting the liner hanger to the casing;

releasing the running tool assembly from the liner assembly;

raising the packer actuator above the packer actuating sleeve; and applying a hydraulic pressure to the hydraulic packer actuator to set the liner top packer, wherein the anchor prevents axial movement of the running tool assembly when the hydraulic pressure is applied to the hydraulic packer actuator to set the liner top packer.

19. The method of claim 18, wherein the hydraulic packer actuator provides an axial force to the packer actuating sleeve to set the liner top packer.

20. The method of claim 18, wherein the anchor comprises a hydraulic anchor.

21. The method of claim 18, wherein the anchor prevents axial movement of the running tool assembly when a cement slurry is provided through the landing string.

22. The method of claim 18, wherein the anchor is adapted to selectively engage the inner surface of the casing.

23. The method of claim 18, wherein the anchor is adapted to selectively engage the inner surface of the liner.

24. The method of claim 18, wherein the anchor assembly allows rotation through the hydraulic anchor while preventing axial movement of the tool string.

25. The method of claim 18, further comprising applying an initial set down force to the running tool assembly before the hydraulic pressure is applied to the hydraulic packer actuator to set the liner top packer.

26. The method of claim 18, further comprising retrieving the running tool assembly from the wellbore.

27. The method of claim 18, further comprising providing a cement slurry through the running tool assembly.

28. A method for setting a packer, comprising:

providing a running tool assembly having a hydraulic packer actuator and a hydraulic anchor assembly;

decoupling the running tool assembly from the packer;

positioning the hydraulic packer actuator above the packer; and applying a hydraulic pressure to actuate the hydraulic anchor assembly to prevent axial movement of the running tool assembly and to actuate the hydraulic packer actuator to set the packer.

29. The method of claim 28, wherein the hydraulic packer actuator sets the packer by applying an axial force to a packer actuating sleeve above the packer.

30. The method of claim 29, further comprising applying an initial set down force to the running tool assembly to resist an initial upward lifting force of the hydraulic packer actuator.

31. The method of claim 28, wherein the running tool assembly is mechanically unattached to the packer when the hydraulic pressure is applied.

32. A hydraulic packer actuator for use in wellbore operations, comprising:

a tubular member having an inner diameter;

a piston moveably coupled to the tubular member, the piston adapted to move axially in relation to the tubular member between an unextended position and an extended position;

a shoulder coupled to the piston, the shoulder expandable from a first outer diameter to a second outer diameter;

a chamber formed between the tubular member and the piston; and a port providing fluid communication between the inner diameter of the tubular member and the chamber, wherein the first outer diameter of the shoulder is smaller than the inner diameter of a packer actuating sleeve and wherein the second outer diameter of the shoulder is greater than the inner diameter of the packer actuating sleeve.

33. The hydraulic packer actuator of claim 32, a hydraulic pressure in the inner diameter of the tubular member moves the piston from an unextended position to the extended position.

34. The hydraulic packer actuator of claim 32, wherein the shoulder comprises one or more spring-loaded dogs.

35. The hydraulic packer actuator of claim 32, wherein the shoulder comprises one or more c-rings.

36. The hydraulic packer actuator of claim 32, wherein the shoulder resides inside the packer actuating sleeve during run in and wherein the shoulder expands to the second outer diameter when removed from the packer actuating sleeve.

37. The hydraulic packer actuator of claim 32, wherein the shoulder is adapted to apply an axial force when the piston moves from an unextended position to the extended position.

38. The hydraulic packer actuator of claim 37, wherein the shoulder is adapted to apply the axial force to a packer actuating sleeve.

39. The hydraulic packer actuator of claim 38, wherein the axial force to the packer actuating sleeve is adapted to set a packer.

40. A hydraulic packer actuator for use in wellbore operations, comprising:

a tubular member having an inner portion;

a piston moveably coupled to the tubular member, the piston adapted to move axially in relation to the tubular member between an unextended position and an extended position;

a chamber formed between the tubular member and the piston;

a port providing fluid communication between the inner portion of the tubular member and the chamber;

a shoulder coupled to the piston, the shoulder is adapted to apply an axial force to a packer actuating sleeve when the piston moves from an unextended position to the extended position, wherein the axial force to the packer actuating sleeve is adapted to set a packer; and an anchor connected to the tubular member and located above the piston, wherein the anchor is adapted to prevent axial movement of tubular member.

41. The hydraulic packer assembly of claim 40, wherein the anchor assembly comprises a hydraulically actuated gripping surface movable between a radially retracted position and a radially extended position and a biasing member biasing the gripping surface in the retracted position.

42. A tool string for use in wellbore operations, comprising:

a hydraulic packer actuator assembly adapted to actuate a liner hanger assembly having a liner hanger and a packer; and a hydraulic anchor assembly adapted to prevent axial movement of the tool string, the hydraulic anchor assembly having a gripping surface movable between a retracted position and an extended position and a biasing member biasing the gripping surface in the retracted position, the gripping surface disposed on a rotatable sleeve such that the hydraulic packer actuator assembly is rotatable when the gripping surface is in the extended position.

43. A tool string for use in wellbore operations, comprising:

a hydraulic anchor assembly adapted to prevent axial movement of the tool string, the hydraulic anchor assembly having:

a tubular member;

one or more piston chambers, each piston chamber in fluid communication with an inner diameter of the tubular member, the one or more piston chambers of the anchor assembly are disposed on a rotatable sleeve;

a piston disposed in each chamber, each piston adapted to move radially and having a gripping surface disposed on an end thereof, the gripping surface movable between a retracted position and an extended position; and a hydraulic packer actuator assembly adapted to actuate a liner hanger assembly having a liner hanger and a packer.

44. The hydraulic assembly of claim 43, further comprising:

a biasing member for biasing the gripping surface in the retracted position.

* * * * *